US010470560B2

(12) United States Patent
Gosling et al.

(10) Patent No.: US 10,470,560 B2
(45) Date of Patent: Nov. 12, 2019

(54) SLIDABLE FURNITURE WITH IN-WALL MOUNTING SYSTEM

(71) Applicant: DIRTT ENVIRONMENTAL SOLUTIONS, LTD., Calgary (CA)

(72) Inventors: Geoff Gosling, Calgary (CA); Mogens Smed, DeWinton (CA)

(73) Assignee: DIRTT Environmental Solutions, Ltd., Calgary (CA)

( * ) Notice: Subject to any disclaimer, the term of this patent is extended or adjusted under 35 U.S.C. 154(b) by 0 days.

(21) Appl. No.: 15/108,626

(22) PCT Filed: May 31, 2016

(86) PCT No.: PCT/US2016/035001
§ 371 (c)(1),
(2) Date: Jun. 28, 2016

(87) PCT Pub. No.: WO2016/200641
PCT Pub. Date: Dec. 15, 2016

(65) Prior Publication Data

US 2018/0192767 A1 Jul. 12, 2018

Related U.S. Application Data

(60) Provisional application No. 62/173,138, filed on Jun. 9, 2015.

(51) Int. Cl.
*A47B 5/00* (2006.01)
*A47B 83/00* (2006.01)
(Continued)

(52) U.S. Cl.
CPC ..... *A47B 5/00* (2013.01); *A47B 21/03* (2013.01); *A47B 63/00* (2013.01); *A47B 83/001* (2013.01);
(Continued)

(58) Field of Classification Search
CPC ..... A47B 5/00; A47B 63/00; A47B 21/03; A47B 95/008; A47C 17/86; A47C 7/002; E04F 13/081
See application file for complete search history.

(56) References Cited

U.S. PATENT DOCUMENTS 4,008,872 A * 2/1977 Thompson ..... A47B 96/067 211/88.01
4,227,466 A * 10/1980 Rooklyn ..... A47F 5/0093 108/102
(Continued)

FOREIGN PATENT DOCUMENTS

DE 29600563 5/1996
DE 102007038825 2/2009
(Continued)

OTHER PUBLICATIONS

International Search Report for application No. PCT/US2016/035001 dated Aug. 22, 2016.
(Continued)

*Primary Examiner* — Babjide A Demuren
(74) *Attorney, Agent, or Firm* — Workman Nydegger

(57) ABSTRACT

A mounting system for mounting a piece of furniture in a movable manner to a modular wall system includes a side support bar that has a channel extending therethrough. The side support bar can be mounted to a modular wall system. A roller assembly is connected to the piece of furniture. The roller assembly includes rollers that can be positioned and moved within the channel to enable the piece of furniture to be selectively repositioned along the modular wall system.

20 Claims, 4 Drawing Sheets

(51) Int. Cl.

| | |
|---|---|
| ***A47B 95/00*** | (2006.01) |
| ***A47B 21/03*** | (2006.01) |
| ***A47B 63/00*** | (2006.01) |
| ***A47C 7/00*** | (2006.01) |
| ***A47C 17/86*** | (2006.01) |
| *A47F 5/08* | (2006.01) |
| *A47B 96/06* | (2006.01) |
| *E04F 13/08* | (2006.01) |

(52) U.S. Cl.

CPC ..... *A47B 95/008* (2013.01); *A47C 7/002* (2013.01); *A47C 17/86* (2013.01); *A47B 96/067* (2013.01); *A47F 5/0853* (2013.01); *E04F 13/081* (2013.01)

(56) References Cited

U.S. PATENT DOCUMENTS

| | | | | |
|---|---|---|---|---|
| 4,615,572 | A | 10/1986 | Nelson | |
| 4,731,960 | A | 3/1988 | Sease | |
| 4,936,534 | A | 6/1990 | Cattaneo | |
| 5,511,675 | A * | 4/1996 | Frederick | A47B 63/00 211/162 |
| 5,549,379 | A * | 8/1996 | Jun | A47B 46/00 211/94.01 |
| 5,597,217 | A | 1/1997 | Hoska | |
| 5,692,817 | A | 12/1997 | Jun et al. | |
| 6,328,571 | B1 | 12/2001 | Dricken | |
| 6,336,564 | B1 * | 1/2002 | Garnier | A47F 5/0068 211/162 |
| 6,374,547 | B1 * | 4/2002 | Baloga | G09F 7/08 160/214 |
| 6,418,671 | B1 | 7/2002 | DeRuiter | |
| 6,854,202 | B1 * | 2/2005 | Ives | G09F 15/0087 40/491 |
| 7,913,459 | B2 * | 3/2011 | Ball | A47B 83/001 52/239 |
| 8,665,582 | B2 * | 3/2014 | Robinson | E05D 15/063 361/644 |
| 9,072,381 | B2 * | 7/2015 | Bates | A47B 95/008 |
| 2010/0212233 | A1 | 8/2010 | Robinson | |

FOREIGN PATENT DOCUMENTS

| | | |
|---|---|---|
| EP | 2859815 | 4/2015 |
| JP | 03038270 | 4/1991 |
| KR | 2019890613115 | 9/1989 |

OTHER PUBLICATIONS

International Search Report for application No. 11201607102W dated Jul. 20, 2017.

Supplementary Europeans Search Report for application No. EP 16808038 completed on Dec. 15, 2017.

* cited by examiner

SLIDABLE FURNITURE WITH IN-WALL MOUNTING SYSTEM

CROSS-REFERENCE TO RELATED APPLICATIONS

The present invention is a 35 U.S.C. § 371 U.S. National Stage of PCT Application No. PCT/US2016/35001, filed May 31, 2016, which claims the benefit of priority to U.S. to U.S. Provisional Application No. 62/173,138, filed Jun. 9, 2015. The entire content of each of the foregoing patent applications is incorporated herein by reference.

BACKGROUND

An organization might purchase or rent a large open space in an office complex, and then subdivide or partition the space into various offices, conference rooms, or cubicles, depending on the organization's needs and size constraints. Rather than having to find new office space and move as an organization's needs evolve over time, it is often needful to have a convenient and efficient means to reconfigure the existing space. Many organizations address their configuration and reconfiguration issues by using reconfigurable wall systems, or reconfigurable modular wall systems.

Not only do modular wall systems give people privacy or aesthetics where permanent walls are lacking, but they are less expensive to set up than permanently constructed office dividers and can be reconfigured in a relatively short period of time. The modular nature also allows for creative thinking in design and provides a personal touch. Thus, an organization can readily take on the challenge of reconfiguring a given space and adapt to changing needs in an efficient and organized manner, and with a personal style.

Within a partitioned office space or conference room, furniture including desks, tables, chairs, couches, or bookcases, etc., may be placed. Office space can be small or be awkwardly defined such that it limits the size and amount of furniture that can be used in the space. Considerations for furniture may include weight, dimension, placement, setup, aesthetics, as well as other considerations. Also, it may be helpful to have furniture be matching so that when expanding or contracting office space size and layout, furniture from one space combined with furniture from another space is still matching. Accordingly, furniture aspects may be addressed to help reshape and elevate an office space and thus meet developing needs.

BRIEF SUMMARY

The present disclosure relates generally to securing furniture or other design or functional components to a wall system. More specifically, the present disclosure relates to systems that allow for furniture or other design or functional components to be movably secured to a wall system such that the furniture or other design or functional components can be readily and selectively repositioned relative to the wall system, and optionally without having to be disconnected from the wall system in order to accomplish the repositioning.

In one implementation, for instance, a mounting system for mounting a piece of furniture to a modular wall system includes a side support bar that has a channel extending therethrough. An associated piece of furniture has a support surface for supporting items or a person thereon. A roller assembly is connected to the piece of furniture and is disposed at least partially within the side support bar to enable the furniture to be (re)positioned along the side support bar. Positioning or repositioning the furniture along the side support bar can position or reposition the furniture along the modular wall system.

In another implementation, a modular wall system with mountable furniture is provided. The modular wall system may include at least one vertical wall having a frame, a tile attachable to the frame, and a cantilever channel opening to an outer face of the at least one vertical wall. The system can also have a side support bar that can be selectively mountable at least partially within the cantilever channel. The side support bar may have a channel extending through at least a portion of the length thereof. A piece of furniture and a roller assembly may also be included as part of the system. The roller assembly may be connected to the piece of furniture and be disposable at least partially within the cantilever channel. The roller assembly and the cantilever channel may cooperate to enable the piece of furniture to be selectively repositioned along the length of the side support bar.

In another implementation, a modular wall system with mountable furniture includes at least one vertical wall with a frame, a tile attachable to the frame, and a cantilever channel opening to an outer face of the at least one vertical wall. The system also includes a piece of furniture that has a support surface for supporting items or a person thereon. A bracket is connected to the piece of furniture and at least a portion of the bracket is disposable at least partially within the cantilever channel. The bracket is selectively movable within the cantilever channel to enable the piece of furniture to be selectively repositioned along the length of the at least one vertical wall.

Additional features and advantages of illustrative and/or exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such illustrative and/or exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments and/or implementations thereof which are illustrated in the appended drawings. Understanding that these drawings depict only typical embodiments and/or implementations of the invention and are not therefore to be considered to be limiting of its scope, the invention will be described and explained with additional specificity and detail through the use of the accompanying drawings in which.

DETAILED DESCRIPTION

It is common for organizations to partition large, open office spaces into individual work areas using reconfigurable wall systems, or reconfigurable modular wall systems. To better serve such systems, furniture for the space can also take the form of a modular type design.

A mounting system for mounting a piece of furniture to a modular wall system can include a side support bar that has a channel extending therethrough, a piece of furniture that has a support surface for supporting items or a person thereon, and a roller assembly connected to the piece of furniture and disposed at least partially within the side support bar to enable the furniture to be (re)positioned along the side support bar.

In another implementation, a modular wall system with mountable furniture is provided. The modular wall system may include at least one vertical wall having a frame, a tile attachable to the frame, and a cantilever channel opening to an outer face of the at least one vertical wall. The system can also have a side support bar that can be selectively mountable at least partially within the cantilever channel. The side support bar may have a channel extending through at least a portion of the length thereof. A piece of furniture and a roller assembly may also be included as part of the system. The roller assembly may be connected to the piece of furniture and be disposable at least partially within the cantilever channel. The roller assembly and the cantilever channel may cooperate to enable the piece of furniture to be selectively repositioned along the length of the side support bar.

Figure 1:
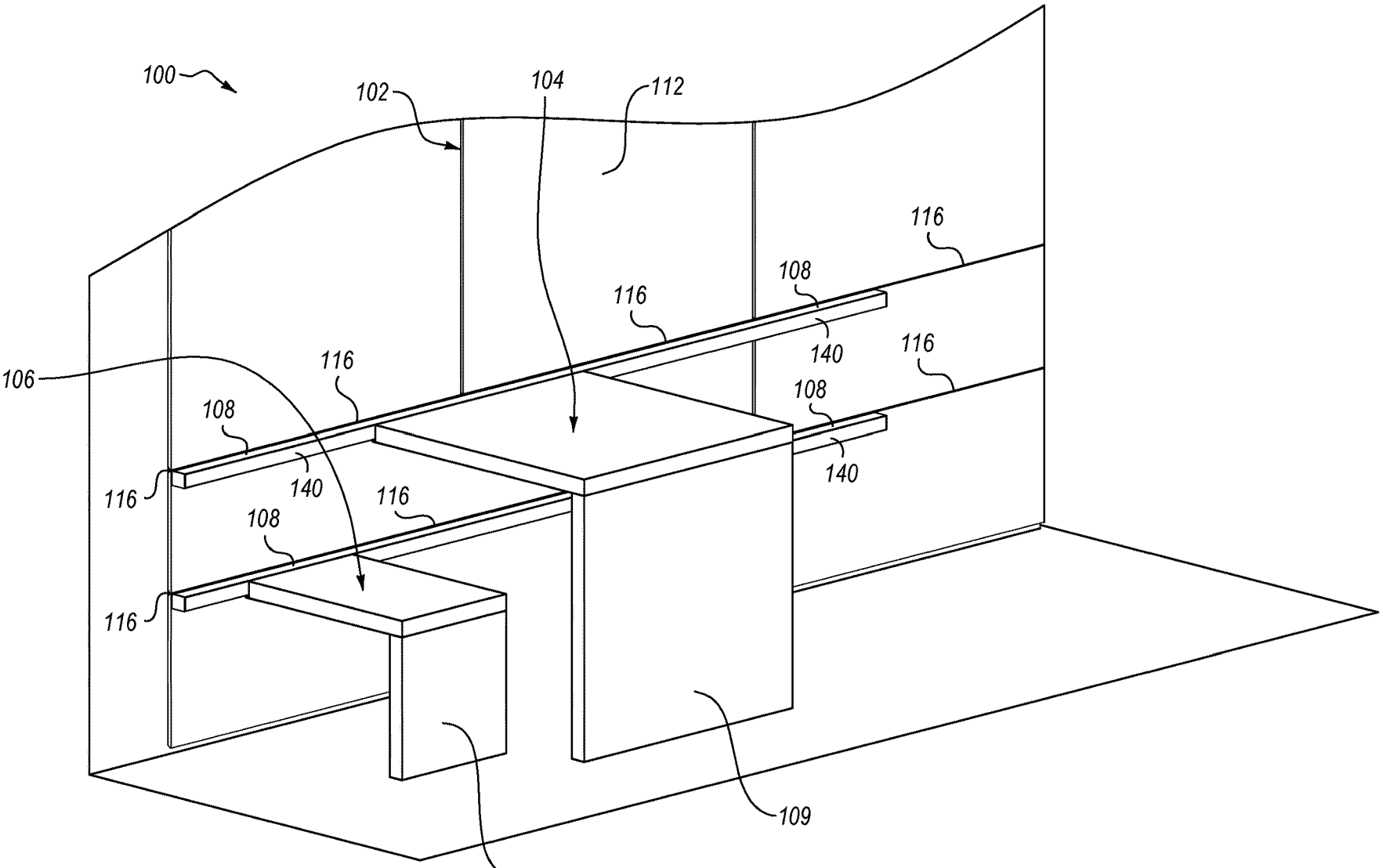
FIG. 1 illustrates a perspective view of a modular wall system with mountable furniture.

Turning to FIG. 1, a modular wall system with incorporated furniture 100 is shown. As shown, the system 100 includes a modular wall system 102 to which a table 104 and a chair 106 are mounted or secured. Mounting or securing of the table 104 and the chair 106 may be accomplished through the use of one or more side support bars 108, as shown. The side support bars 108 may be attached to vertical and/or horizontal structures (discussed below) and/or tiles 112 of the modular wall system 102.

The table 104 and chair 106 are slidably connected to the side support bars 108 such that they can slide or otherwise move relative to the side support bar 108 while staying joined to the side support bar 108. In the illustrated embodiment, the table 104 and chair 106 each have a vertical support 109 and 110, respectively, that extends from a support surface (e.g., table top, seat) to a floor. The vertical supports 109, 110 balance the support provided by the side support bar 108. In other words, the vertical supports 109, 110 extend from the end of the support surface (opposite the modular wall system 102) to the floor so as to support the end of the support surfaces the table 104 and chair 106. It can readily be appreciated that a vertical support may be located at various locations on the support surface, such as the center, sides, or other locations. Also, more than one vertical support may be provided for a given piece of furniture.

Moreover, there may be furniture that has no vertical support such that the entire weight of the furniture is supported by the modular wall. There may be more than one side support bar such that there are multiple points of attachment on a piece of furniture and thus no need for a vertical support. This may be beneficial to provide additional space in an office, for example. Besides tables and chairs, there may other types of furniture used in a modular office environment. For example, furniture may include a desk, a couch, a shelf, a painting, a bench, as well as other types of furniture. As shown, two side support bars are used to accommodate height differences of the table 104 and chair 106. The two side support bars 108 are shown as being horizontal, however, they may be angled or vertical according to desire. Additionally, while the present system 100 is illustrated as including both the table 104 and the chair 106, it will be appreciated that systems according to the present disclosure may include only a table 104, only a chair 106, multiple tables and/or chairs, and/or one or more other types of furniture.

The table 104 and chair 106 may be moved by lifting their ends (opposite the modular wall system 102) and then sliding them in one direction or the opposing direction parallel to the side support bar 108. Lifting the ends of the table 104 and the chair 106 can reduce or eliminate the friction between the vertical supports 109, 110 and the floor, thereby making it easier to reposition the table 104 and the chair 106 along the length of the side support bar 108. When lifting the ends of the table 104 or chair 106, a slight tilt or angle may be created between the furniture and the floor or side support bar 108. As discussed in greater detail below, the connection between the table 104 or chair 106 and the associated side support bar 108 may facilitate the tilting of the table 104 or chair 106 relative to the associated side support bar 108.

Figure 2:
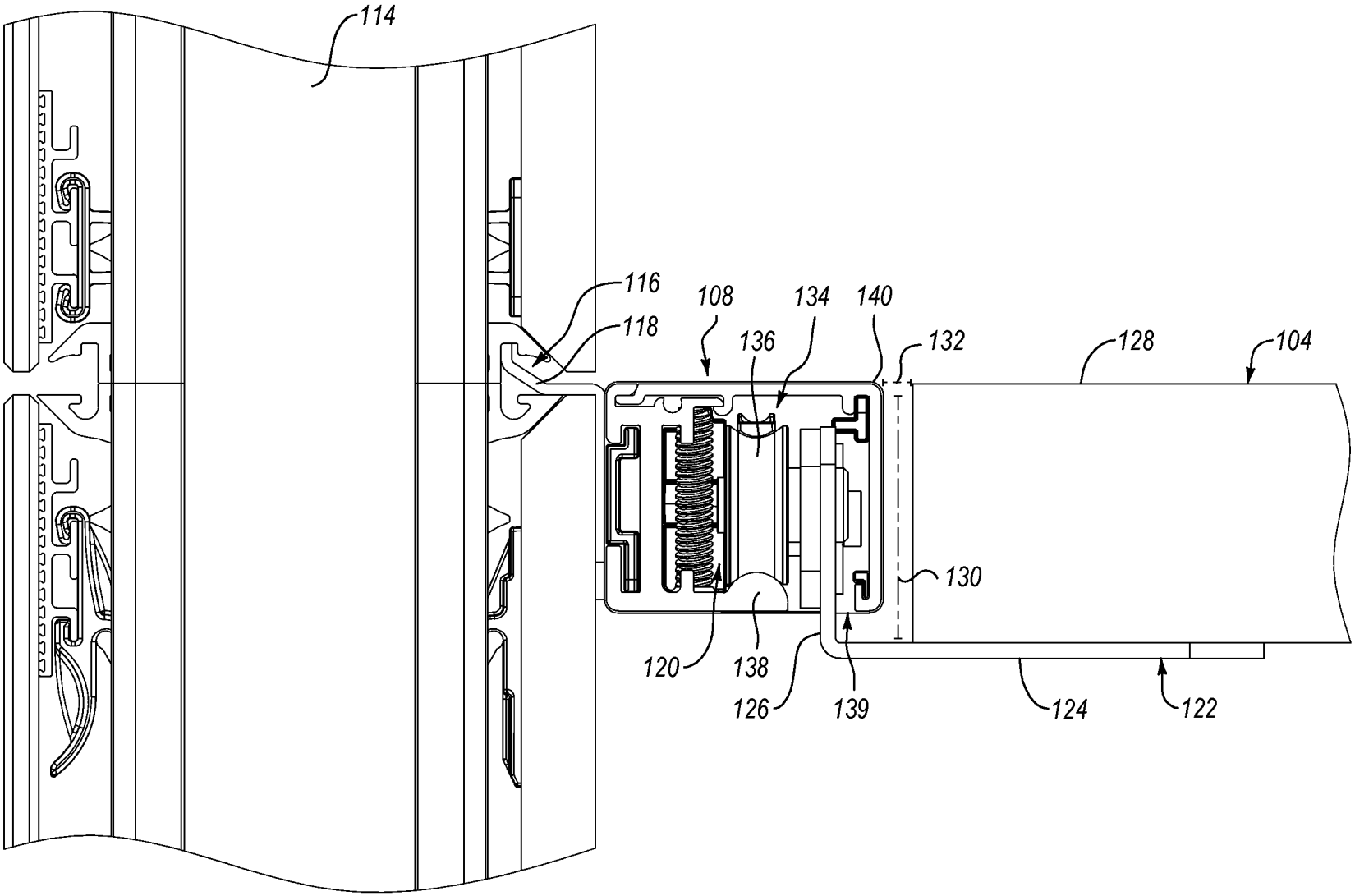
FIG. 2 illustrates a cross-sectional view of a mounting system for movably mounting the mountable furniture to a modular wall.

Turning to FIG. 2, a partial cross-sectional view is shown of the system 100 for mounting the table 104 to the modular wall system 102. The chair 106 or another piece of furniture may be mounted to the modular wall system 102 in a similar manner. Accordingly, the following discussion is equally applicable to the chair 106 or other furniture that may be mounted to the modular wall system 102.

As can be seen in FIG. 2, the modular wall system 102 includes a frame 114 that has a cantilever channel 116 therein. The cantilever channel 116 spans a generally horizontal distance, vertical distance, or other distance that is generally parallel to the side support bar 108 and is used to support the side support bar 108. More specifically, the side support bar 108 includes one or more lever arms 118 that may be inserted into the cantilever channel 116 to mount the side support bar 108 to the frame 114.

The one or more lever arms 118 may be inserted into the cantilever channel 116 by tilting the side support bar 108 upwards so that an end of the lever arm 118 can be inserted into the cantilever channel 116. After the end of the lever arm 118 is inserted into the cantilever channel 116, the side support bar 108 can be tilted downwards so that the cantilever channel 116 counteracts the gravitational and rotational forces on the side support bar 108 to hold the side support bar 108 in a mounted (e.g., horizontal) position on the modular wall system 102. A portion of the side support bar 108 can also rest against an outer surface (e.g., a tile) of the module wall system 102 to help maintain the side support bar 108 in the mounted (e.g., horizontal) position shown in FIG. 2.

Although the illustrated embodiment shows the side support bar 108 having a single lever arm 118 that is mounted in the cantilever channel 116, it will be appreciated that each side support bar 108 may have multiple lever arms 118 disposed at one or more locations along the length thereof.

A bracket 122 is used to mount the table 104 to the side support bar 108. The bracket 122 may include a first side 124 and a second side 126. In the illustrated embodiment, the first and second sides 124, 126 form a 90 degree angle, but may form other angles as desired and needed. For instance, the angle may be in a range between about 75 degrees and about 110 degrees. The first side 124 may be attached to at least a portion (e.g., underside) of a support surface 128 of the table 104. The support surface 128 may correspond to a tabletop, but may correspond to a seat of a chair, for example. A roller assembly 134 with rollers 136 is attached to the second side 126 of the bracket 122. When the roller assembly 134 is at least partially inserted into a channel 120 in the side support bar 108, the rollers 136 may rest on a track 138 which is provided within the channel 120.

The bracket 122 and associated roller assembly 134 may be associated (e.g., mounted, inserted, etc.) with the side support bar 108 in various ways. For instance, the roller assembly 134 and at least a portion of the second side 126 of the bracket 122 can be inserted in the channel 120 of the side support bar 108 through an open end in the side support bar 108. The open end in the side support bar 108 may be closed off after the roller assembly 134 and portion of the second side 126 are positioned within the channel 120. The side support bar 108 may include a slot 139 through which the second side 126 of the bracket 122 may pass or extend. According to the embodiment of FIG. 2, for example, the slot 139 may be formed in a lower surface of the side support bar 108, such that the second side 126 extends upwardly through the slot 139 and into the channel 120.

In some embodiments, the side support bar 108 may include a cover 140 that can be selectively removed to allow for the roller assembly 134 to be mounted on the track 138. Once the roller assembly 134 is mounted on the track 138, the cover 140 may be the attached to cover the roller assembly 134. In some embodiments, the cover 140 cooperates with other portions of the side support bar 108 to form the slot 139, to allow for the second side 126 of the bracket 122 to pass through or extend out of the side support bar 108.

In still other embodiments, the slot 139 or a portion thereof may be sized and/or otherwise configured to allow for the roller assembly 134 and the portion of the second side 126 of the bracket 122 to be inserted into the channel 120 through the slot 139. For instance, the support surface 128 of the piece of furniture may be tilted and lifted so that the roller assembly 134 enters the slot 139 in the underside of the side support bar 108. The furniture may then be tilted and lowered to position the rollers 136 on the track 138.

Space for tilting and lifting the support surface 128 relative to the side support bar 108 is enabled by vertical and horizontal gaps between the side support bar 108 and the second side 126 of the bracket 122. More particularly, the bracket 122 may be configured to provide a horizontal gap 132 between the support surface 128 and the side support bar 108 as well as a vertical gap 130 between the first side 124 of the bracket 122 and the side support bar 108. The horizontal gap 132 exists between the side support bar 108 and the support surface 128 by the bracket attachment being spaced from the support surface 128. Similarly, the vertical gap 130 exists between the side support bar 108 and the first side 124 of the bracket 122 by the bracket attachment being spaced from the side support bar 108.

In addition to attachment assistance, the vertical and horizontal gaps 130, 132 may also provide a space for lifting and tilting the support surface 128 for removing the support surface 128 from its mounted position along the side support bar 108. Furthermore, the vertical and horizontal gaps 130, 132 may provide a space for lifting and tilting the support surface 128 when repositioning the support surface 128 along the side support bar 108. Note that the vertical and horizontal gaps 130, 132 may have the same width or different widths.

Figure 3:
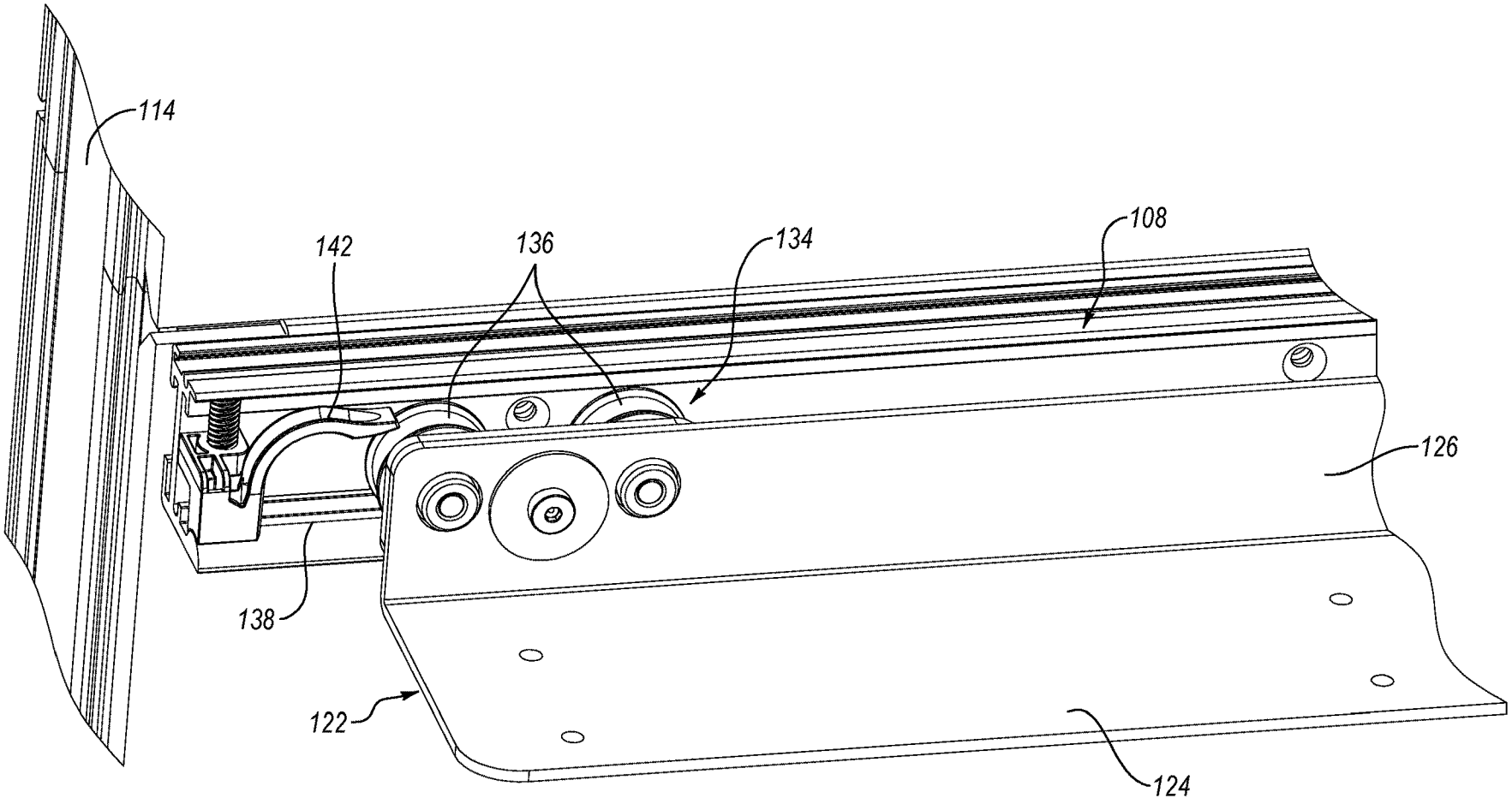
FIG. 3 illustrates a cutout view of a roller assembly used to position mountable furniture along a modular wall.

Turning to FIG. 3, a perspective cutaway view is shown of the attachment between the side support bar 108 and the bracket 122 with the roller assembly 134. As shown, the roller assembly 134 comprises rollers 136 that have curved surfaces so as to rest on the track 138, which includes a complementarily curved surface. As shown, the rollers 136 have inverted, or concave, curvature along an outer surface. The track 138 has an outer curve, or convex curvature. The complementary curvatures help to secure the rollers 136 to the track 138 as the support surface 128 is being moved and also when the rollers 136 are at rest. Other types of joinder are possible. For example, the rollers 136 and track 138 may have no curvature and the track 138 may instead have an inset in which the rollers 136 may be placed. In another example, the bracket 122 may omit rollers 136 entirely and simply slide or glide along a flat track within the channel 120.

As shown, a stop 142 may also be included in the channel 120 of the side support bar 108. The stop 142 may be a flexible, curved flange. When the roller assembly 134 is advanced against the stop 140, the curved flange may act as a dampener to slow the movement of the roller assembly 134 and the associated piece of furniture. The curved flange of the stop 140 may also flex to open slightly to allow at least one of the rollers 136 to pass underneath. The curved flange of the stop may then resiliently spring back to a resting position with the curved flange slightly wrapped around at least a portion of the roller 136. For instance, one of the rollers 136 may be positioned underneath a portion of the stop 140 to temporarily secure the roller assembly 134 and the associated piece of furniture in a desired position.

A stop 142 may be located at either or both ends of the side support bar 108 to limit the movement of the roller assembly 134 and the associated piece of furniture. There may also be intermediate stops located in other positions within the channel 120. Such intermediate stops may allow for the roller assembly 134 and the associated piece of furniture to be secured in various predetermined positions along the length of the side support bar 108. In some embodiments, the intermediate stops may include one or more flexible, curved flanges that can slow and/or stop the roller assembly 134. The one or more flexible, curved flange may be open on opposing ends such that the rollers 136 may enter and exit from both ends.

Whether for the end stops 142 or the intermediate stops, flexible, curved flanges are not the only option available. Rather, a stop may simply be a vertical structure that is placed in a desired location within the channel 120 to dampen or stop movement of the roller assembly 134 and/or an associated piece of furniture.

It is also envisioned that instead of a side support bar 108 containing a channel 120 separate from the modular wall 102, the modular wall 102 may have one or more internal channeled members included in the vertical walls, horizontal supports, or tiles. The support surfaces may then be bracketed and inserted into the internal channeled members thereof. In other words, the side support bar, or components, or functional characteristics thereof may be incorporated into the modular wall 102 instead of having a separate side support bar 108 disposed between the modular wall 102 and the piece of furniture.

Figure 4:
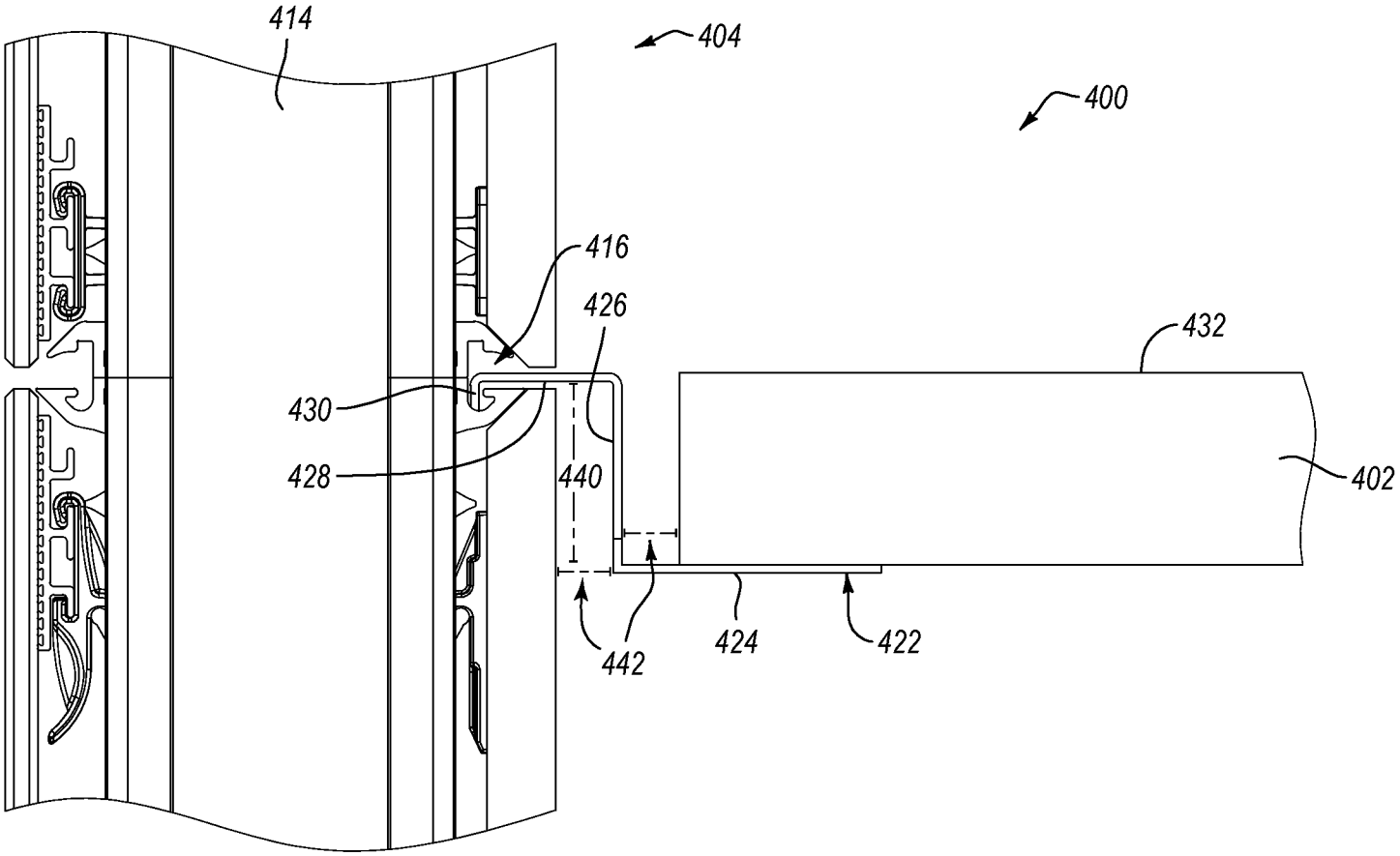
FIG. 4 illustrates a cross-sectional view of a mounting system for movably mounting mountable furniture to a modular wall.

For instance, in the illustrated embodiment of FIG. 4, a partial cross-sectional view is shown of a variation of a system 400 for mounting a table 402 to a modular wall system 404. The modular wall system 404 includes a frame 414 that has a cantilever channel 416 therein. The cantilever channel 416 spans a generally horizontal distance, vertical distance, or other distance relative to a ground level. The frame 414 and/or cantilever channel 416 can be similar or identical to the frame 114 and/or cantilever channel 116 described above in FIGS. 1-2.

Instead of a support bar being removably mounted to the cantilever channel 416, a bracket 422 is directly mounted to between the table 402 and the cantilever channel 416. In the illustrated embodiment, the piece of furniture 402 has a support surface 432 similar to the other furniture described herein. The bracket 422 may be configured to slide through at least a portion of the length of the cantilever channel 116 in order to allow for the piece of furniture 402 to be selectively repositioned along the length of the cantilever channel 416 and/or modular wall system 404.

The bracket 422 may include a number of bends and/or curves to facilitate attachment between the piece of furniture 402 and the cantilever channel 416. For example, the bracket 422 may include a first side 424 that is horizontal and/or parallel to, and attached to, an underside of the support surface 432. A second side 426 bends at a 90 degree angle relative to the first side 424. A third side 428 bends at a 90 degree angle in a direction towards-and perpendicular with-the opening of the cantilever channel 416. A fourth side 430 (or end of bracket 422) bends at a 90 degree angle to be vertical, and/or to be parallel to the frame 414. The bracket 422 is removably mounted to the modular wall system 404 as the fourth side 430 is removably inserted within the cantilever channel 416.

Although the bracket 422 is shown and described in a particular configuration, the bracket 422 may be configured in a variety of ways. For instance, the above-noted angles and configuration of the bracket 422 may vary. For example, angles between sides may be in a range between about 75 degrees and about 110 degrees. Additionally, the bracket 422 may be formed with gradual transitions such that some or all of the above-noted sides of the bracket 422 are not readily distinguishable from one another. Furthermore, the bracket 422 may be configured to engage the cantilever channel 416 in various ways. For instance, although FIG. 4 illustrates the bracket 422 resting in the lower portion of the cantilever channel 416, the bracket 422 may also or alternatively engage the upper portion of the cantilever channel 416.

Similar to the other embodiments described herein, a vertical gap 440 and/or one or more horizontal gaps 442 may be included and used for tilting, lifting, and lowering the bracketed furniture for engagement and disengagement to the cantilever channel 416. For example, FIG. 4 shows that, after the end (fourth side 410) of bracket 422 is inserted into the cantilever channel 416, the cantilever channel 416 holds the support surface 432 in a mounted (e.g., horizontal) position on the modular wall system 404. Note that the vertical gap 440, and horizontal gaps 442 may have the same width or different widths as one another or the other gaps described herein. Also, there may be no vertical gap 440 or horizontal gap(s) 442.

It will be appreciated that multiple brackets 422 may be disposed at one or more locations along the length of the cantilever channel 416. Also, the fourth side 430 may include a roller assembly with rollers which may be at least partially inserted and roll within the cantilever channel 416. The rollers may rest on a track which is optionally provided within the cantilever channel 416.

The present invention may be embodied and/or implemented in other specific forms without departing from its spirit or essential characteristics. The described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A mounting system for mounting a piece of furniture to a modular wall system, the mounting system comprising:

a side support bar that has a channel extending therethrough, the channel comprising a track with a curved surface;

a piece of furniture that has a support surface for supporting items or a person thereon;

a roller assembly connected to the piece of furniture and movably disposed at least partially within the side support bar to enable the furniture to be selectively repositioned along a length of the side support bar, the roller assembly comprising a plurality of rollers disposed on the curved surface of the track of the side support bar;

wherein the piece of furniture is connected to the side support bar at a point beneath the side support bar via a bracket having perpendicular first and second sides, where one of the first and second sides provides a support surface connected to the piece of furniture, and where the other of the first and second sides is connected to the plurality of rollers.

2. The mounting system in claim 1, further comprising a vertical support attached to the piece of furniture and configured to extend from the piece of furniture to a floor.

3. The mounting system in claim 1, wherein the side support bar includes an attachment bracket for attaching within a cantilever channel.

4. The mounting system in claim 3, wherein the bracket is configured to provide a horizontal gap between the support surface and the side support bar.

5. The mounting system in claim 3, wherein the bracket is configured to provide a vertical gap between the first side of the bracket and the side support bar.

6. The mounting system in claim 1, wherein the side support bar includes a cover, such that the side support bar encloses and conceals the plurality of rollers.

7. The mounting system in claim 1, wherein the side support bar includes a stop positioned at least one end of the channel to selectively limit the movement of the roller assembly.

8. A modular wall system with mountable furniture, the modular wall system comprising:

at least one vertical wall, the at least one vertical wall comprising:

a frame;

a tile attachable to the frame; and an elongate cantilever channel having an opening to an outer face of the at least one vertical wall, wherein the elongate cantilever channel extends along a horizontal width of the at least one vertical wall, the elongate cantilever channel comprising an L-shaped cavity behind the tile, the elongate cantilever channel being accessible from a front surface of the tile;

a side support bar selectively mountable at least partially within the elongate cantilever channel via at least one lever arm, the lever arm being insertable into the L-shaped cavity of the elongate cantilever channel, the side support bar having a channel extending through at least a portion of the length thereof;

a piece of furniture that has a support surface for supporting items or a person thereon; and a roller assembly connected to the piece of furniture on one side, and connected from a point beneath the side support bar to a point within the channel of the side support bar, the roller assembly and the channel of the side support bar cooperating to enable the piece of furniture to be selectively repositioned along the length of the side support bar.

9. The modular wall system of claim 8, wherein the roller assembly comprises a bracket having a first arm and a second arm.

10. The modular wall system of claim 9, wherein the first arm is connected to the piece of furniture.

11. The modular wall system of claim 9, wherein a plurality of rollers is connected to the second arm.

12. The modular wall system of claim 11, wherein the plurality of rollers is configured to move along a track disposed in the channel of the side support bar.

13. The modular wall system of claim 9, wherein the bracket is configured to create a gap between the side support bar and the piece of furniture.

14. The modular wall system of claim 9, wherein the bracket is configured to create a gap between the side support bar and the first arm of the bracket.

15. The modular wall system in claim 8, wherein the side support bar includes at least one end stop positioned at an end of the channel or at least one intermediate stop disposed between opposing ends of the channel to selectively limit the movement of the roller assembly within the channel.

16. A modular wall system with mountable furniture, the modular wall system comprising:

at least one vertical wall, the at least one vertical wall comprising:

a frame;

a tile attachable to the frame; and a cantilever channel having an opening to an outer face of the at least one vertical wall, wherein the cantilever channel extends along a horizontal width of the at least one vertical wall, the cantilever channel comprising an L-shaped cavity behind the tile, the cantilever channel being accessible from a front surface of the file;

a piece of furniture that has a support surface for supporting items or a person thereon; and a bracket comprising at least three sides, the bracket connected to the piece of furniture on a first side of the at least three sides, at least a portion of the bracket being disposable at least partially within the cantilever channel via a second side of the at least three sides, a third side of the at least three sides being perpendicular to the first side and the second side and arranged such that a gap forms between the at least one vertical wall and the third side when the second side is at least partially disposed within the cantilever channel, the bracket being selectively movable within the cantilever channel to enable the piece of furniture to be selectively repositioned along the length of the at least one vertical wall.

17. The modular wall system of claim 16, wherein the bracket is slidable within the cantilever channel.

18. The modular wall system of claim 16, further comprising a roller assembly connected to the bracket.

19. The modular wall system of claim 18, wherein the roller assembly comprises one or more rollers that enable the bracket to roll through the cantilever channel.

20. The modular wall system of claim 16, further comprising one or more stop disposed in the cantilever channel to limit the movement of the bracket within the cantilever channel.

* * * * *